United States Patent [19]

Rosen et al.

[11] 4,171,337

[45] Oct. 16, 1979

[54] PROCESS FOR FORMING CERAMIC BODIES EMPLOYING AQUEOUS LUBRICANT

[75] Inventors: Meyer R. Rosen, Spring Valley, N.Y.; David B. Braun, Ridgefield, Conn.; Stephen Drap, Pawling, N.Y.

[73] Assignee: Union Carbide Corporation, New York, N.Y.

[21] Appl. No.: 856,979

[22] Filed: Dec. 2, 1977

[51] Int. Cl.[2] ..... B28B 3/20

[52] U.S. Cl. ..... 264/56; 106/38.22; 264/176 R; 264/338

[58] Field of Search ..... 252/49.3; 264/176 R, 264/133, 134, 170, 56; 106/38.22, 338

[56] References Cited

U.S. PATENT DOCUMENTS

| | | | |
|---|---|---|---|
| 1,783,287 | 12/1930 | Hilgendorf | 264/176 R |
| 3,925,216 | 12/1975 | Moorhouse | 252/49.3 |

OTHER PUBLICATIONS

Singer, *Industrial Ceramics*, pp. 733–734 (1963).

*Primary Examiner*—Robert F. White
*Assistant Examiner*—John A. Parrish
*Attorney, Agent, or Firm*—Bernard Francis Crowe

[57] ABSTRACT

A process for forming green ceramic bodies using an aqueous solution of a high molecular weight, water-soluble polymer as a lubricant.

15 Claims, 1 Drawing Figure

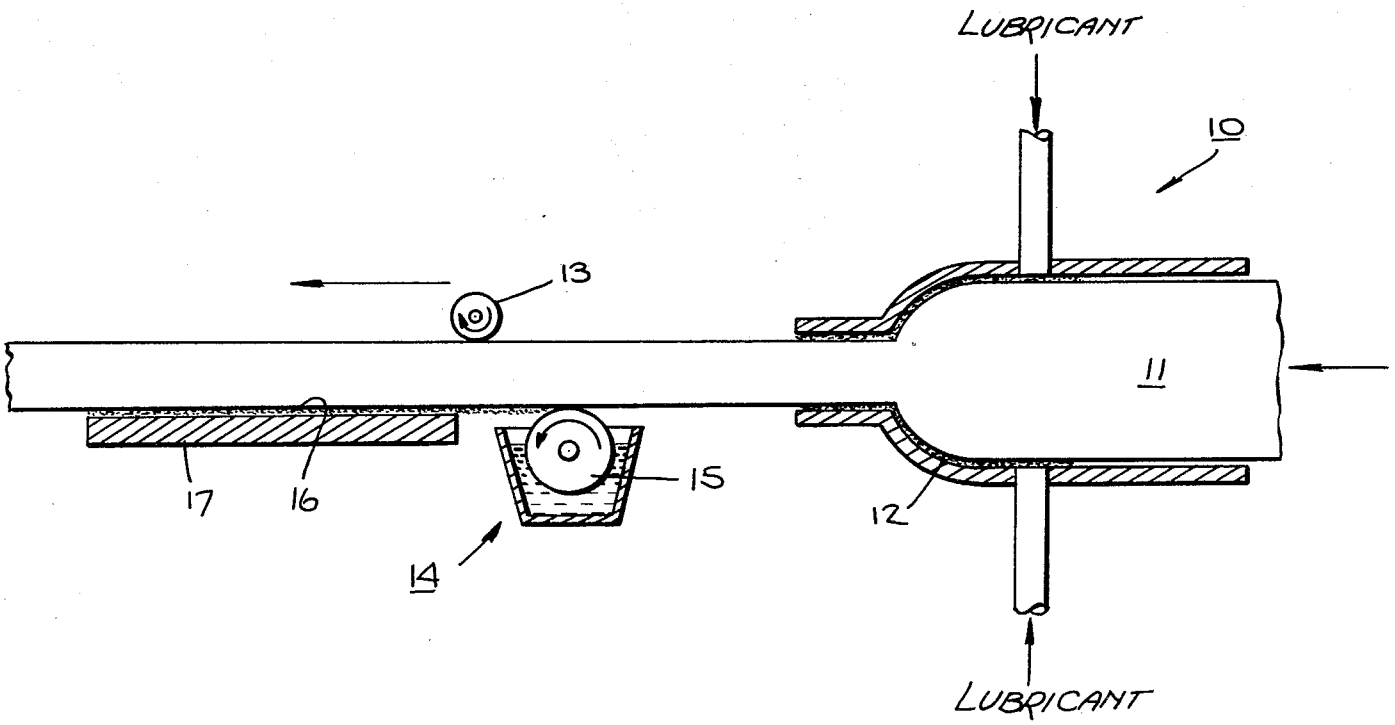
10
LUBRICANT
11
LUBRICANT
12
13
14
15
16
17

PROCESS FOR FORMING CERAMIC BODIES EMPLOYING AQUEOUS LUBRICANT

CROSS-REFERENCE TO RELATED APPLICATION

This application is related to commonly-assigned application Ser. No. 856,980, filed concurrently herewith on Dec. 2, 1977, by Meyer R. Rosen and David B. Braun for "RAPIDLY-DISSOLVED WATER-SOLUBLE POLYMER COMPOSITION".

The invention relates to a process for forming ceramic bodies, and more particularly to a process for forming ceramic bodies using metallic forming or shaping apparatus wherein an external lubricant is used during forming at the metallic/ceramic body interface.

A ceramic body can be defined as a shaped, non-metallic, inorganic material which has been thermally processed (i.e., fired or cured). These products are usually formed from a wet body of a material such as clay by shaping the wet clay into a desired configuration and firing the resulting "green" (i.e., uncured) body to dry and cure the same.

A variety of ceramic bodies are formed or shaped by extrusion, stamping, molding and the like. For example, typical ceramic bodies include structural clay products (e.g., building or construction brick, sewer pipe, flower pots, flue liners, terra cotta, etc.), refractory products (e.g., magnesite and chromite refractory brick and various other extruded shapes) and white ware products (e.g., electrical porcelain insulators, sanitary ware, china, etc.). As used herein, the term "ceramic body" is meant to include any shaped and cured configuration composed of clay or other similar material, since the particular ceramic body and the materials used in producing same are not critical parts of the present invention. For ease of description only, the present invention will be exemplified by reference to the formation of ceramic bodies from clay, although those skilled in the art are aware that the scope of the invention is not to be so limited.

Typically, in the forming of a ceramic body from clay, a porous, wet, hydrophilic clay composition or body is forced into contact with one or more metal (e.g., steel) surfaces to shape the clay into a desired configuration. To aid in the shaping process, internal and/or external lubricants may be required or desired; an internal lubricant being one which is mixed within the bulk of the clay while an external lubricant is one which is delivered to or provided at the interface of the clay and the metal of the forming surface. The present invention is concerned with the external type of lubricants used in processes for forming ceramic bodies which employ metallic forming or shaping surfaces.

Such external lubricants are known in the prior art. Typical lubricants are petroleum derivatives such as naphthenic base oils, diesel oil, fish oils and the like; and coconut oil-derived soap solutions. For example, a lubricant such as diesel oil may be injected into the die of an extruder to improve the flow of the wet clay through the die, or the lubricant may be sprayed onto a wet ceramic "pug" just prior to forming the pug in a mold, to make forming easier and to lubricate the wet (green) body so that it can be removed from the mold after it has been formed without the distortion of the wet material. Care must be taken to use the proper amount of a lubricant in a process such as an extrusion process, since excess lubricant will result in holes or the like on the external surfaces of the formed ceramic body, while an inadequate amount of or no lubricant may result in a tearing or like defacing of the ceramic product being extruded.

Such petroleum derivatives, while being effective, suffer from various disadvantages. These include a rapidly increasing price, health hazards associated with airborne mists which may be formed by the use of such materials in unconfined areas, fire and explosion hazards, contamination of the surfaces of formed ceramic products due to the presence of the lubricant, the need for relatively expensive oil-resistant material handling apparatus to transport the ceramic pieces during processing, etc.

In summary, the present invention comprises the use of a certain aqueous lubricant in a process for forming green ceramic bodies. Although forming no part of the present invention, such green ceramic bodies may be fired and/or cured using conventional techniques. The lubricant is an aqueous solution of a high molecular weight, water-soluble polymer. The preferred polymer is a homopolymer of ethylene oxide having an average molecular weight in the range of 100,000 to 5,000,000 and a solid density (true density) in the range of 1.15 to 1.26. The solution also preferably, although not necessarily, contains a corrosion inhibitor. The lubricant used in the present invention remedies many of the disadvantages of known prior art lubricants.

The FIGURE is a schematic representation of an extrusion process for forming ceramic bodies according to the present invention.

The present invention will be described by referring to two types of ceramic body forming processes; specifically, an extrusion process for preparing products such as ceramic brick and a molding process for preparing a ceramic product like a flower pot or the like. It is not intended to limit the scope of the present invention to such processes since in its broadest aspect, the present invention contemplates the use of the lubricant described herein in any process for forming a green ceramic body wherein a metallic forming or shaping surface or surfaces are employed.

Ceramic brick are usually formed by an extrusion process or a pressing process. A mixture is first formed of, for example, 60% hard shale, 20% soft shale and 20% filler, and water is added thereto with mixing to obtain a uniform wet clay composition containing about 15–18% by weight of water although higher and lower amounts of water may be employed depending upon, inter alia, the clay composition, the processing conditions and the apparatus. The wet clay mixture is then fed to an extruder which is normally and conveniently constructed of a metal such as steel. Referring to the FIGURE, an extruder 10 has the wet clay mixture 11 fed thereto in the direction indicated by the arrow. As the wet clay is extruded from the metallic extruder, a lubricant is pumped to or otherwise provided at the interface 12 between the clay 11 and the metallic extruder 10. The FIGURE is exaggerated at this interface in order to provide a more complete understanding of the present invention. Suitable means such as cutters (not shown) may be provided at the outlet of extruder 10 in order to cut or otherwise shape the extruder "green" (i.e., uncured) ceramic body.

In order to provide lubrication between the extruded body and any metallic surface in contact therewith, means of providing lubrication may be included. For example, lubricant bath 14 containing a lubricant solution may be provided on the underside of the moving extruded green body. Roller 15 is provided in the bath to apply the lubricant to the bottom surface of the extruded body such that interface 16 between the bottom surface thereof and the surface on which the extruded material is moving (such as steel plate 17) is lubricated.

At any suitable point after extrusion, the extruded green body may be cut into any desired shape using any conventional cutting apparatus (not shown), and similarly, the upper exposed face of the extruded material may be treated to achieve any shape and/or appearance desired as is conventional in the art. Additional means (not shown) may be employed to provide lubricant to that surface of the extruded material which contacts or moves along any other surface at any point in the operation. For example, the upper surface of the extruded material may be contacted with an embossing roll 13 to shape the top of the bricks with grooves or the like and at this point, suitable means may be provided if desired to provide lubricant to protect the surface of the brick. Finally, the green body is fired or baked using conventional techniques to cure the ceramic body.

Another process for forming a ceramic body is a molding process to produce products such as clay pots and the like. A wet clay mixture, such as the type described above or any other type known to those skilled in the art is extruded or otherwise shaped into a "pug", i.e., a cylinder-shaped article. Where a clay pot is being manufactured, the pug which bears a coating of the lubricant thereon is placed into a female mold, and just prior to forcing a corresponding male mold therein, the pug may again be coated with additional lubricant to facilitate removal of the formed pot from both halves of the mold. The green article is then fired.

The clay mixture used to form a ceramic body may also contain, as is known to those skilled in the art, a plasticizer such as kaolinitic and illitic ball clay, china clay, fire clay, or shale. The plasticizer may also contain accessory minerals such as montmorillinite and chlorite. A filler, if desired, may also be incorporated therein and typical fillers are quartz and alumina. Additionally, a flux such as feldspar may also be incorporated therein. The function of the plasticizer is to assist the forming properties of the wet mixture while the flux produces a glassy matrix. Depending upon the forming process employed and the firing temperature and final ceramic properties required or desired, various ceramic products contain more or less of the above ingredients or other conventional additives, such as colorants, etc. It is not the intention to limit the present invention to any particular type of clay or ceramic products.

The lubricant used in the process of the present invention, in its broadest sense, is an aqueous solution of a high molecular weight, water-soluble polymer. The concentration of the polymer in the solution can be varied over a wide range from a minimum of about 0.1% by weight to a maximum of 10% by weight, based on the total weight of the solution.

Preferably, the solution also contains a corrosion inhibitor to retard metal corrosion by the aqueous polymer solution. The particular corrosion inhibitor used is not critical and any well-known corrosion inhibitor may be employed in the practice of the present invention. Typical known corrosion inhibitors which may be employed in the present invention include sodium nitrite, potassium dichromate, sodium benzoate, a variety of water-soluble amines such as hexamethylene diamine, pyridine and the like. The amount of corrosion inhibitor is not critical and will be equal to that amount necessary to achieve corrosion inhibition. The typical and preferred concentration of the corrosion inhibitor in the practice of the present invention is an effective amount less than 0.01% by weight, based on the total weight of the solution.

The preferred high molecular weight water-soluble polymer is a homopolymer of ethylene oxide having an average molecular weight between 100,000 and 5,000,000 and a solid density between 1.15 and 1.26. Such polymers are, for example, available from Union Carbide Corp. under the tradename POLYOX Resins. Its preferred concentration in the aqueous solution is from 0.3 to 3% by weight, based on the total weight of the solution. Further, copolymers of ethylene oxide with one or more polymerizable olefin monoxide comonomers can be employed in the present invention. The amount of the polymerizable olefin monoxide comonomer is not particularly critical and is limited only to the extent that the resulting copolymer must be water-soluble, as is apparent to those skilled in the art. Such olefin monoxide comonomers have a sole vicinal epoxy group; i.e. a

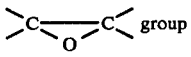

and typical examples of such a comonomer are 1,2-propylene oxide, 2,3-butylene oxide, 1,2-butylene oxide, styrene oxide, 2,3-epoxy hexane, 1,2-epoxy octane, butadiene monoxide, cyclohexene monoxide, epichlorohydrin, and the like. Preferred ethylene oxide coplymers include copolymers of ethylene oxide with butylene oxide and/or styrene oxide having up to about 15 weight percent of the olefin monoxide comonomer, based on the total weight of the copolymer. The term "copolymer" is used herein in its generic sense; that is, to include any polymer formed via the polymerization of two or more polymerizable monomers. The preparation of such homopolymers and copolymers of ethylene oxide is well documented in the literature; e.g., see U.S. Pat. Nos. 2,969,403, 3,037,943 and 3,167,519.

Other water-soluble polymers which can be employed in the lubricant of the invention include a wide range of commercially available types over a molecular weight range of from 100,000 to 20,000,000. These include materials such as:

neutralized poly(acrylic acid), such as those sold under the Trademark Carbopol 940 by B. F. Goodrich Co., a high molecular weight poly(acrylic acid) neutralized with a base such as NaOH to form a sodium poly(acrylate).

anionic, cationic and nonionic poly(acrylamides), such as those sold under the Trademarks Nalco 625 by Nalco Corp., hydrolyzed anionic poly(acrylamide), and Separan CP-7 by Dow Chemical Co., a cationic poly(acrylamide);

quaternary nitrogen-containing cellulose polymers, such as those sold under the Trademark Polymer JR 30M by Union Carbide Corp., a quaternary nitrogen-containing cellulose polymer;

cationic poly(amide-amines), such as those sold under the Trademark Catareten F-8 by Sandoz Corp., a cationic poly(amide-amine); and nonionic ethylene oxide adducts of cellulose, such as those sold under the Trademark CELLOSIZE Hydroxyethyl Cellulose QP52,000 by Union Carbide Corp., a nonionic ethylene oxide adduct of cellulose.

To recapitulate, the essential ingredient in the lubricant of the invention is the high molecular weight, water-soluble polymer with the corrosion inhibitor being a preferred additive. However, as pointed out below, the lubricant may contain other ingredients, in small amounts, depending upon the method used for its production.

One method for preparing a lubricant solution using the preferred homopolymer of ethylene oxide is as follows. The required amount of the ethylene oxide polymer is gently shaken into the necessary amount of vigorously boiling water which is being rapidly stirred to form a vortex. As the vortex decreases due to solution thickening, the mixing speed is increased. Upon complete polymer addition, the mixing speed is decreased to about 50 rpm and the solution is then stirred for about one to two hours.

A preferred technique for preparing a lubricant solution of the invention is described in the aforementioned commonly-assigned copending application Ser. No. 856,980, filed concurrently herewith. As described in said copending application, a non-aqueous concentrate is formed which provides, upon dilution with water, a lubricant solution of the high molecular weight, water-soluble polymer. The concentrate comprises:

(a) the high molecular weight, water-soluble polymer in particulate form, (b) a water-insoluble, organic liquid vehicle which is a non-solvent for said particulate polymer in sufficient amounts to coat said particulate polymer.

(c) an inert, nonionic surfactant agent compatible with said organic vehicle having a hydrophilic-lipophilic balance (HLB) in the ranges of 3–5 and 9–13 in sufficient amounts to remove said organic liquid vehicle coating on said particulate polymer upon dilution with water, and, (d) an inert thickening agent in amounts from about 0% to 5% by weight of said concentrate to retard stratification of said composition when fluidized.

One method of preparing the non-aqueous concentrate is as follows. The water-insoluble organic vehicle is blended with the surfactant agent under agitation. Shortly thereafter, the thickening agent is slowly added and the resulting mixture is stirred for about five minutes. Next, the stirred mixture is blended by high-shear mixing for a period of about five minutes until a homogeneous dispersion is obtained. Finally, the particulate, high molecular weight, water-soluble polymer is blended with the dispersion under high shear conditions for about 10 minutes until a homogeneous dispersion is obtained. The preferred particle size of the polymer is 0.01–1000 microns, most preferably 50–250 microns. The specific amount of the various ingredients which may be employed in the concentrate are as follows:

polymer: 1–99%, preferably 10–99% by weight organic vehicle: 5–99% by weight surfactant agent: 0.1–20%, preferably 1–10% most preferably 1–5% by weight thickener: 0–5%, preferably 0.5–3% by weight It has been postulated that the water-insoluble organic vehicle coats the polymer particles in a hydrophobic sheath. The nonionic surfactant agent is compatible with the insoluble vehicle. When the composition is added to water the surfactant carries the hydrophobic sheath or coating from the polymer particles at the proper rate to free the particles and allow them to disperse in water without clumping or agglomerating. Each particle therefore has an opportunity to separate from each other on addition of water and then to dissolve in the water.

When the composition is formed in a fluid state, the inert thickener retards the normally more dense polymer from settling out of the composition as a strata below the normally less dense insoluble vehicle.

If the lubricant solution is prepared by diluting the non-aqueous concentrate with water, the organic vehicle, surfactant agent and thickener may be present therein, but only as a byproduct of this particular method of forming the solution. These ingredients are not necessary to obtain the lubricant properties desired in the final solution. If desired, the vehicle may be recovered from the solution since, as pointed out above, the surfactant acts to remove the coating of the vehicle from the polymer particles when the concentrate is diluted with water. Since the organic vehicle is non-water-soluble, it can form a separate layer on the surface of the solution.

The selection of the organic liquid vehicle is not particularly limited and includes materials such as a liquid hydrocarbon (e.g., mineral oils, kerosenes, naphthas, etc.), and liquid propylene oxide polymers which may be either butanol started (e.g., fluids available from Union Carbide Corp. under the Trademark UCON LB285) or dipropylene glycol started (e.g., fluids available from Union Carbide Corp. available under the Trademark PPG-1025). Particularly useful organic vehicles are the refined paraffin naphthenic hydrocarbons commonly known as mineral oils. Examples of suitable mineral oils include those available from Marathon Morco Co. under the Trademarks Sontex 150 and Sontex 95T. Also useful are branched chain isoparaffinic solvents, examples of which are the isoparaffinic solvents sold under the Trademark Isopar (Trademark of Exxon Corp.) such as Isopar L. Typical properties for Isopar and Sontex materials are shown below in Tables I and II.

TABLE I

| Property | Isopar L | Test Method |
|---|---|---|
| Viscosity, cSt. at 15.5° C. | 2.6 | ASTM D445 |
| Pounds/Gallon, 60/60° F. | 6.39 | |
| Surface Tension, dyne/cm. at 25° C. | 23.1 | |
| Flash Point, °F. | 142 | ASTM D56 |
| Boiling Point, °F. IPB | 380 | ASTM D86 |
| Dry Point | 403 | |
| Composition | | |
| Average molecular weight | 171 | Cryogenic Mass |
| Hydrocarbon type | Vol. % | Spectrometer |
| Total Saturates | 99.9% | |
| Aromatics | 0.1% | |
| Olefins | 0.03% | Calculated from Bromine Index. |

TABLE II

| | Sontex 150 | Sontex 95T |
|---|---|---|
| Property | | |
| Viscosity, cSt. at 100° F. | 32 | 19.3 |
| Pounds per gallon | 7.26 | 7.12 |
| Flash Point (COC) °F. | 365 | 360 |
| Composition | | |
| Average Molecular Weight | 367 | 364 |
| Naphthenes, % | 41 | 35 |
| Paraffins, % | 59 | 65 |

If present in the final lubricant solution, the organic vehicle is usually present as an emulsion in the polymer solution. This emulsion can be of the oil-in-water type or of the water-in-oil type. Whichever type, it may be well dispersed and therefore non-settling, or it may be poorly dispersed in the solution and therefore tend to separate as a layer on the surface of the solution. If present in the solution, the organic vehicle is usually within the range of from 0.1 to 1.98% by weight based on the total weight of the solution.

The surfactant agent is a nonionic emulsifier or blend of emulsifiers which is compatible with the organic vehicle and may either be soluble in it or form a stable colloidal dispersion with it. Preferred emulsifiers are organic types which include ethoxylated long chain fatty acids, sorbitan fatty acid esters and mono and diglycerides. The most preferred emulsifiers include mixtures of sorbitan fatty acid esters (available from ICI-United States under the Trademarks SPAN 65, 80 and 85) and polyoxyethylene sorbitan fatty acid esters (available from ICI-United States under the Trademarks TWEEN 65, 80 and 85). The surfactant, if present in the lubricant solution, is present in the range of 0.001 to 0.5%, preferably 0.02 to 0.2% by weight, based on the total solution weight.

The thickening agent may not be necessary if the concentrate is sufficiently viscous. Normally, with amounts of polymer exceeding 70% by weight of the concentrate, no thickener is needed. However, if necessary, it is added to the concentrate to increase the viscosity of the organic vehicle sufficiently so that it coats the polymer particles. The particular thickener employed is not critical and any thickener capable of increasing the viscosity of the organic vehicle can be used, such as finely divided silica (e.g., precipitated or fumed silica) and the like, a metallic soap (e.g., the metal salts of higher monocarboxylic organic acids, preferably stearates,—typical metals include aluminum, calcium, iron, lead, lithium, magnesium, sodium and zinc), and the like. Preferably, an aluminum stearate is used (available from Witco Chemical Company under the Trademarks Aluminum Stearate No. 22 or No. 30). If present in the solution, the thickener is present in an amount of from 0.04 to 0.12% by weight, based on the total solution weight.

The use of poly(ethylene oxide) in lubricant compositions for hydrophobic, non-porous surfaces is known in the prior art. See, for example, U.S. Pat. Nos. 3,227,652, 3,925,216 and 3,152,990. Lubricating hydrophilic porous surfaces, such as those of wet clay compositions, presents problems which are different from lubricating hydrophobic, non-porous surfaces such as metallic surfaces. Whereas a metallic surface does not normally absorb a lubricant, a wet clay composition would eventually absorb an aqueous polymer solution. It has been unexpectedly discovered that at the proper weight concentrations of polymer, substantial lubricity is achieved with the lubricant solution of the invention in a process for forming a ceramic body. Although not wishing to be bound by any particular theory, it has been theorized that at the proper concentrations, the higher the viscosity of the lubricant of the invention, the slower the penetration into the clay body. The slower it penetrates into the clay body, the longer the lubricity is retained. In the solutions of the invention the viscosity is a function of the shear rate. The viscosity is inversely proportional to the shear rate. In contrast, in conventional oil lubricants, the viscosity is independent of the shear rate.

It is believed that lubrication in the present invention is obtained by means of a thin layer of lubricant which exists between the metallic shaping apparatus and the clay body. This viscous cushion of lubricant is maintained for a sufficient time by appropriately controlling the concentration and molecular weight of the polymer.

The following examples will further illustrate the advantages of the present invention. In Examples 2–32, certain lubricant compositions are tested. The test used in each Example consisted of three steps: making a plastic clay body, preparing a compressed clay pellet and finally measuring the lubricity of the clay pellet against a steel surface. These three steps were conducted as follows.

1. Making a Plastic Clay Body

Three hundred and fifty grams of clay body is added to a Brabender Plasticorder (Trademark of Brabender) (Model PL-V151) with attached pug mill head, using cooling water at 23° C. The moisture content of the clay body is known, having previously been determined using an Ohaus Model 6010 (Trademark of Ohaus) moisture balance (10 minutes at number 7 heat setting). With the mixer rotating at 40 RPM, scale range set at 0–2500 metergrams, sensitivity at 1:25 and range at x5, water is metered into the clay body at a constant rate of 1 cc/min using a Masterflex pump model 7545. Enough water is added to bring the moisture content to about 18% (based on dry weight). Water content will be varied according to standard usage for the particular clay body. Torque buildup with water addition is recorded. A plexiglass plate is inserted into the mixing bowl to a depth of 1.5 cm to inhibit "riding up" of the clay body during mixing.

2. Preparing the Clay Pellet

Having mixed the clay body and water to the desired water content, about 6 gram samples are weighed and immediately wrapped in Saran Wrap (Trademark of Dow Chemical Co.) to prevent moisture loss. The pellets are prepared using a stainless steel "pellet press" which consists of a 1.5" diameter cylinder, 2.5" high with a 0.75" center hole. Pellets are pressed between a long plunger and short base. The long plunger is 0.75" diameter and 3" high and the short base is 0.75" diameter and 0.5" high. To form a pellet, (0.75" diameter and 0.4" high) a spacer of TEFLON (Trademark of E. I. duPont de Nemours and Company) brand fluorocarbon (0.75" diameter by 0.25" high) is inserted on top of the short base. The clay body is unwrapped, pressed on top of the spacer, followed by insertion of a second spacer and finally the long plunger. The assembled apparatus is placed in a Carver laboratory press, Model C (Trademark of Carver) and a load of 8000 lb. is applied.

The pellet is removed from the press, weighed and wrapped in Saran Wrap (Trademark of Dow Chemical Co.) until ready for use. This procedure was successful in keeping water loss to a minimum for up to several weeks although lubrication tests were usually run within several hours of pellet preparation. This procedure avoided clay pellet syneresis problems.

3. Lubricity Measurement

This part of the test involved measuring the change in torque with time developed by a clay pellet rotating against a surface of a steel plate. After beginning rotation, the clay pellet is allowed to spin for one minute or until the recorded torque value reaches close to the maximum scale value (which is 100, equivalent to $4.9\times10^5$ dyne-cm torque). During this period, the measured torque value oscillates between minimum and maximum values which are associated with the kinetic and static coefficients of friction. The value of torque after 1 minute, using the minimum in the oscillation, is denoted $T_C$ and is used as a control, where no lubricant is added.

The same procedure is repeated after adding a small quantity of lubricant to the steel surface between it and the rotating pellet. Three parameters can be measured during this period which are useful for assessing lubricity effects. $T_L$, $\delta_1$, and $\delta_2$. $T_L$ is the lowest torque reading obtained after lubricant has been added. $(T_C-T_L)$ is a torque measurement which is related to the degree of friction force reduction. $\delta_1$ is the time it takes to reach the lowest torque $T_L$ and $\delta_2$ is the time the lowest torque is retained.

Having established values of $T_C$, $T_L$, $\delta_1$ and $\delta_2$, the last part of the test involves pulling the steel plate away from the non-rotating clay body and observing whether or not the clay adheres to the steel.

Using the data above, an assessment can be made as to the lubricant's performance. Desirable lubricants will have large values of $(T_C-T_L)$ (e.g.: to a maximum of about 100) and will not permit adherence of the clay pellet to the steel. Other useful criteria for judging acceptable lubricity include a small $\delta_1$ (i.e.: it takes a short time (e.g.: about 0.1 min) for good lubricity to develop) and a large $\delta_2$ (i.e.: the lubricant is effective for as long as possible—e.g.: about 2 minutes or longer). Optimal variations of $\delta_1$ and $\delta_2$ will vary with the particular clay body composition. A fourth useful parameter to judge lubricant effectiveness is observation of whether there is clay adherence to the steel at the end of the test.

It is important to note that different clay bodies can have different requirements for acceptable lubricity as determined by the foregoing lubricity test: For example, only a small value of $(T_C-T_L)$ may be necessary in certain systems. A value of 13 was considered adequate for one system (clay body I—see below) since compositions of the present invention were field tested with clay body I and had sufficient lubricity.

It is typical of the aqueous based lubricants of the present invention that friction force decreases after lubricant addition, remains low for some period of time and thereafter begins to increase. The increase occurs presumably because the lubricant is being absorbed into the clay body. This behavior is typical of the novel compositions claimed herein and differs significantly from the behavior of petroleum based lubricants which do not appear to be absorbed by the clay body.

In some of the Examples, Lubricant "A" is employed and has the following composition and properties:

| Trademark | Composition | Properties |
|---|---|---|
| Texnap 100 "Brick Oil" | Naphthenic base oil | |
| | Pour Point | −55° F. |
| | Specific Gravity | 23.7° API |
| | Flash Point | 330° F. COC |
| | Viscosity, SUS | 105 at 100° F. 37.8 at 210° F. |
| | % Aromatics | 38.6 |
| | %Saturates | 60.4 |
| | % Polar | 1.0 |
| | No additives | |

Lubricant "B" is the 0.5% polymer solution prepared in Example 1.

Further, Clay Bodies I and II are clays used for construction face brick and were obtained respectively from Glen-Gery Corporation and Pine Hall Brick Company; Clay Bodies III and IV are clays used for flower pots and were respectively obtained from Marshall Pottery Company and Keller Pottery Company.

EXAMPLE 1

Preparation of Lubricant Solution From Concentrate 1447 grams of Sontex 150 brand of mineral oil, flash point (COC) 365° F. (72.35%) was blended with 20 grams (1%) of a blend of Tween 80/Span 80 (Trademarks) (7/3 weight ratio). 33 grams of Cab-O-Sil M-5 (Trademark of Cabot Corporation) (1.65%) fumed silica were added and the mixture stirred at 70 rpm for 5 minutes followed by high shear mixing with a Cowles Dissolver. Mixing was accomplished with a 3" diameter blade set at 1.25" from the container bottom. The blade rotated at 2000 rpm for 5 minutes. Three hundred grams of the above mixture was then mixed with 100 grams (25%) of POLYOX WSRN-3000* and mixed under high shear, using the Cowles Dissolver for 10 minutes at 2000 rpm.

* The various materials referred to herein as "POLYOX" are homopolymers of ethylene oxide and the designations used are Trademarks of Union Carbide Corp.

The following Trademarks correspond to the corresponding products as follows:

| Trademarks | Compositions | HLB |
|---|---|---|
| Span 65 | Sorbitan tristearate | 2.1 |
| Span 80 | Sorbitan monooleate | 4.3 |
| Span 85 | Sorbitan trioleate | 1.8 |
| Tween 65 | Polyoxyethylene (20) sorbitan tristearate | 10.5 |
| Tween 80 | Polyoxyethylene (20) sorbitan monooleate | 15 |
| Tween 85 | Polyoxyethylene (20) sorbitan trioleate | 11 |
| POLYOX Resin WSRN-3000 (Union Carbide Corporation) | $H-(OCH_2CH_2)_x-OH$ | High molecular weight poly (ethylene oxide) M.W. about 400,000 |

The resulting concentrate is formed into a solution as follows. Into a 400 ml high form beaker, 200 ml of distilled water is added. Using a variable speed lab stirrer set at 60 rpm, with a three blade, 2 inch diameter propeller, a vortex is formed. To form a 0.5% polymer solution, for example, 4 g of 25% polymer slurry is rapidly added (less than 5 sec.) and the solution stirred for 15 minutes.

EXAMPLE 2

The following example demonstrates that Lubricant B is effective as a lubricant on clay body I.

| | $T_C-T_L$* | $\delta_1$ | $\delta_2$ | Clay-Steel Adherence |
|---|---|---|---|---|
| Lubricant B | 13 | 0.1 | 0.1 | none |

*To convert $(T_C-T_L)$ to dyne-cm, multiply by $4.9 \times 10^3$.

EXAMPLE 3

This example demonstrates the effect of Lubricant A on Clay Body I. This petroleum oil lubricant is commonly used for the extrusion of construction brick.

| | $T_C$-$T_L$ | $\delta_1$ | $\delta_2$ | Clay-Steel Adherence |
|---|---|---|---|---|
| Lubricant A | 82 | 0.1 | 2.0+ | none |

Although ($T_C$-$T_L$) for Lubricant A is greater than that obtained with Lubricant B and that $\delta_2$ is also larger, Lubricant B is sufficiently effective to be acceptable in practice.

The solutions of Examples 4–32 were prepared according to the boiling water technique as previously described and were free from non-solvent vehicles and surfactant agents.

EXAMPLE 4

This example demonstrates that a 0.5% aqueous solution of a POLYOX WSR 301, a 4 million molecular weight poly(ethylene oxide) is an effective lubricant on Clay Body I.

| | $T_C$-$T_L$ | $\delta_1$ | $\delta_2$ | Clay-Steel Adherence |
|---|---|---|---|---|
| POLYOX WSR 301 (0.5% in water) | 68 | 0.5 | 0.1 | none |

EXAMPLE 5

This example demonstrates that a 0.8% aqueous solution of POLYOX WSR 301 is effective as a lubricant on Clay Body I.

| | $T_C$-$T_L$ | $\delta_1$ | $\delta_2$ | Clay-Steel Adherence |
|---|---|---|---|---|
| POLYOX WSR 301 | 53 | 0.4 | 0.3 | none |

EXAMPLE 6

This example demonstrates that POLYOX WSRN 60K, with molecular weight intermediate between WSRN 3000 and WSR 301, is also effective on Clay Body I. While the molecular weight is not known at present, this polymer can be characterized by its 1% aqueous viscosity of 271 cP obtained with a Brookfield Viscometer, Spindle LV-2 at 60 RPM.

| | $T_C$-$T_L$ | $\delta_1$ | $\delta_2$ | Clay-Steel Adherence |
|---|---|---|---|---|
| POLYOX WSRN 60K (0.8% in water | 48 | 0.3 | 0.1 | none |

EXAMPLES 7–18

Examples 7–18 demonstrate that lubricants useful for the present invention are selected based on both molecular weight and concentration. For any particular molecular weight, polymer concentration in water is an important variable. Generally, for a given molecular weight, better lubricity, as measured by higher values of ($T_C$-$T_L$), results at higher polymer concentrations. While optimal combinations of molecular weight and concentration will vary with the particular clay body and polymer used, it may be generally said that useful combinations will be those ranging from high molecular weight-low concentration to low molecular weight-high concentration. The following examples illustrate this principle for: a 4 million molecular weight POLYOX WSR 301 (Examples 7 and 8); a 600,000 molecular weight POLYOX WSR 205 (Examples 9 and 10); a 400,000 molecular weight POLYOX WSRN 3000 (Examples 11 and 12); a 300,000 molecular weight POLYOX WSRN 750 (Examples 13 and 14); a 200,000 molecular weight POLYOX WSRN 80 (Examples 15 and 16); and a 100,000 molecular weight POLYOX WSRN 10 (Examples 17 and 18). Examples 7 through 18 are on Clay Body II.

| Example | Lubricant | $T_C$-$T_L$ | $\delta_1$ | $\delta_2$ | Clay-Steel Adherence |
|---|---|---|---|---|---|
| 7 | POLYOX WSR 301 (0.5% in water) | 19 | 0.3 | 0.1 | YES |
| 8 | POLYOX WSR 301 (0.8% in water) | 83 | 0.2 | 0.1 | NO |
| 9 | POLYOX WSR 205 (0.5% in water) | 23 | 0.9 | 0.5 | YES |
| 10 | POLYOX WSR 205 (3% in water) | 87 | 0.1 | 0.6 | Slight |
| 11 | POLYOX WSRN 3000 (0.5% in water) | 18 | 0.1 | 0.5 | YES |
| 12 | POLYOX WSRN3000 (1.8% in water) | 87 | 0.7 | 0.2 | NO |
| 13 | POLYOX WSRN750 (0.5% in water) | 25 | 0.1 | 0.1 | YES |
| 14 | POLYOX WSRN750 (3% in water) | 89 | 0.1 | 0.3 | NO |
| 15 | POLYOX WSRN80 (0.5% in water) | 29 | 0.1 | 0.1 | YES |
| 16 | POLYOX WSRN80 (3% in water) | 82 | 0.7 | 0.2 | NO |
| 17 | POLYOX WSRN10 (2% in water) | 16 | 0.1 | 0.1 | YES |
| 18 | POLYOX WSRN10 (10% in water) | 94 | 0.1 | 0.3 | Slight |

EXAMPLES 19–24

The following examples demonstrate that the lubricants of the present invention are effective on Clay Bodies III and IV used for the manufacture of flower pots. The examples also illustrate the principle noted in Examples 7 through 18 that lubricity is a function of both polymer molecular weight and concentration.

| Ex. | Lubricant | $T_C$-$T_L$ | $\delta_1$ | $\delta_2$ | Clay-Steel Adherence | Clay Body |
|---|---|---|---|---|---|---|
| 19 | POLYOX WSRN 60K (1% in water) | 87 | 1.0 | 0.8 | YES | III |
| 20 | POLYOX WSRN 60K (2% in water) | 79 | 0.1 | 2.0 | NO | III |

Example 20 demonstrates that a 2% solution of POLYOX WSRN 60K is effective in increasing the value of $\delta_2$ to 2.0 which is highly desirable and similar to that obtained with brick oil (Example 3). The polymer of Example 20 retains the lowest torque ($\delta_2$) for a period of time equal to that of brick oil.

| Ex. | Lubricant | $T_C$-$T_L$ | $\delta_1$ | $\delta_2$ | Clay-Steel Adherence | Clay Body |
|---|---|---|---|---|---|---|
| 21 | POLYOX WSR1105 (1.2% in water) | 3 | 0.9 | 0.1 | YES | III |
| 22 | POLYOX WSR1105 (3% in water) | 41 | 1.2 | 0.6 | NO | III |
| 23 | POLYOX WSRN3000 (0.5% in water) | 17 | 0.3 | 0.2 | YES | IV |
| 24 | POLYOX WSRN3000 (1.8% in water) | 88 | 0.5 | 0.2 | Slight | IV |

EXAMPLES 25–30

The following examples demonstrate that other high molecular weight water soluble polymers are also effective according to the teachings of the present invention. These examples are all on Clay Body II.

EXAMPLE 25

This example demonstrates that neutralized high molecular weight poly(acrylic acid) polymers are useful.

| Lubricant | $T_C$-$T_L$ | $\delta_1$ | $\delta_2$ | Clay-Steel Adherence |
|---|---|---|---|---|
| CARBOPOL 940 (0.8% in water) | 91 | 0.1 | 0.1 | Slight |

EXAMPLE 26

This example demonstrates that anionic poly(acrylamide) polymers are useful.

| Lubricant | $T_C$-$T_L$ | $\delta_1$ | $\delta_2$ | Clay-Steel Adherence |
|---|---|---|---|---|
| Nalco 625 (0.8% active in water) | 83 | 1.2 | 0.2 | Slight |

EXAMPLE 27

This example demonstrates that quaternary nitrogen containing cellulose polymers are useful.

| Lubricant | $T_C$-$T_L$ | $\delta_1$ | $\delta_2$ | Clay-Steel Adherence |
|---|---|---|---|---|
| Polymer JR 30M (0.8% in water) | 82 | 1.0 | 0.7 | NO |

EXAMPLE 28

This example demonstrates that cationic poly(acrylamide) polymers are useful.

| Lubricant | $T_C$-$T_L$ | $\delta_1$ | $\delta_2$ | Clay-Steel Adherence |
|---|---|---|---|---|
| Separan CP-7 (0.8% in water) | 57 | 1.0 | 0.1 | YES |

EXAMPLE 29

This example demonstrates that cationic poly(amide-amine) polymers are useful.

| Lubricant | $T_C$-$T_L$ | $\delta_1$ | $\delta_2$ | Clay-Steel Adherence |
|---|---|---|---|---|
| Cartaretin F-8 (0.8% in water) | 51 | 0.7 | 0.1 | NO |

EXAMPLE 30

This example demonstrates that nonionic ethylene oxide adducts of cellulose are useful.

| Lubricant | $T_C$-$T_L$ | $\delta_1$ | $\delta_2$ | Clay-Steel Adherence |
|---|---|---|---|---|
| HEC QP52,000 (0.8% in water) | 41 | 0.5 | 0.2 | YES |

EXAMPLES 31 and 32

These Examples illustrate the relatively poor lubricity achieved with respect to construction brick clay (Example 31) and flower pot clay (Example 32) with water alone, Glycerole (a 5% aqueous solution of coconut oil derived soap) and a poly(ethylene oxide) concentrate (the 25% polymer concentrate produced in Example 1).

| Example | Lubricant | ($T_C$-$T_L$) | $\delta_1$ | $\delta_2$ | Clay/ Steel Adherence |
|---|---|---|---|---|---|
| 31 | Water | 33 | 0 | 0 | Stuck |
| | Glycerole | 10 | 0 | 0 | Stuck |
| | Concentrate | 19.5 | 0 | 0.3 | Stuck |
| 32 | Water | 14 | 0.1 | 0.2 | Stuck |
| | Glycerole | 16.5 | 0.1 | 0.1 | Stuck |
| | Concentrate | 13 | 0.3 | 0.2 | Very slight sticking |

What is claimed is:

1. In a process for forming a shaped green ceramic body including conforming a wet clay composition to one or more metallic surfaces, and providing a lubricant at the interface between said wet clay composition and said metallic surfaces during said conforming, the improvement comprising using as said lubricant an aqueous solution of a high molecular weight, water-soluble polymer.

2. The process of claim 1 wherein said polymer is a homopolymer of ethylene oxide or a copolymer thereof with at least one copolymerizable olefin monoxide comonomer.

3. The process of claim 1 wherein said polymer is selected from the group consisting of neutralized polyacrylic acid, polyacrylamides, quaternary nitrogen-containing cellulose polymers, cationic polyamide-amines and nonionic ethylene oxide adducts of cellulose.

4. The process of claim 1 wherein the weight concentration of said polymer in said solution is from about 0.1% to about 10%.

5. The process of claim 1 wherein said shaping comprises extruding said wet clay composition from a metallic extruder die.

6. The process of claim 1 wherein said shaping comprises conforming said wet clay composition to the surfaces of a mold having the same configuration as said shaped ceramic body.

7. The process of claim 1 wherein said solution further contains a sufficient amount of a corrosion inhibitor to inhibit corrosion of said metallic surfaces by said solution.

8. The process of claim 1 further comprising the step of providing said lubricant between said green ceramic body and one or more of any metallic surface which it contacts prior to said firing step.

9. The process of claim 2 wherein said polymer has an average molecular weight of from 100,000 to 5,000,000.

10. In a process for forming a shaped green ceramic body including conforming a wet clay composition to one or more metallic surfaces, and providing a lubricant at the interface between said wet clay composition and said metallic surfaces during said conforming, the improvement comprising using as said lubricant an aqueous solution consisting essentially of (a) from 0.1% to 10% by weight, based on the total weight of the solution, of a water-soluble ethylene oxide polymer having an average molecular weight of from 100,000 to 5,000,000 and a solid density of from 1.15 to 1.26, wherein said ethylene oxide polymer is a homopolymer of ethylene oxide or a copolymer thereof with at least one copolymerizable olefin monoxide comonomer, and optionally (b) less than 0.01% by weight, based on the total weight of said solution, of a corrosion inhibitor.

11. The process of claim 10 wherein said solution contains from 0.3% to 3% by weight, based on the total solution weight, of said ethylene oxide polymer.

12. The process of claim 10 wherein said comonomer is an olefin having a single vicinal epoxy group

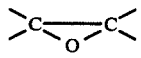

and which may be present in said copolymer in an amount of up to 15% by weight, based on the total weight of the copolymer.

13. The process of claim 10 wherein said aqueous solution is prepared by diluting in water a non-aqueous concentrate formed by blending particles of said polymer with (a) a water-insoluble organic liquid vehicle which is a non-solvent for said polymer and in a sufficient amount to coat said polymer particles, (b) a non-ionic surfactant compatible with said organic vehicle and present in a sufficient amount to remove said coating when said concentrate is diluted with water, and optionally (c) a thickening agent.

14. In a process for forming a shaped ceramic body including the steps of (1) shaping a green ceramic body by conforming a wet clay composition to one or more metallic surfaces, and providing a lubricant at the interface between said wet clay composition and said metallic surfaces during said conforming, and (2) firing said green ceramic body to dry and cure the same and thereby provide said shaped ceramic body; the improvement comprising said lubricant consisting essentially of an aqueous solution of (a) from 0.1% to 10% by weight, based on the total weight of the solution, of a water-soluble polymer having an average molecular weight of from 100,000 to 20,000,000 wherein said polymer is selected from the group consisting of neutralized poly(acrylic acid), poly(acrylamides), quaternary nitrogen-containing cellulose polymers, cationic poly(amide-amines) and non-ionic ethylene oxide adducts of cellulose; and optionally, (b) less than 0.01% by weight, based on the total weight of said solution, of a corrosion inhibitor.

15. The process of claim 13 wherein said solution contains from 0.3% to 3% by weight, based on the total solution weight, of said polymer.

* * * * *